United States Patent [19]

Schlessing

[11] Patent Number: 4,653,699

[45] Date of Patent: Mar. 31, 1987

[54] COAL-MILL CLASSIFIER

[75] Inventor: Johann Schlessing, Klein-Blittersdorf, Fed. Rep. of Germany

[73] Assignee: EVT Engergie-und Verfahrensteckhnik GmbH, Stuttgart, Fed. Rep. of Germany

[21] Appl. No.: 729,778

[22] Filed: May 2, 1985

[51] Int. Cl.[4] ..... B07B 7/08; B02C 23/12

[52] U.S. Cl. ..... 241/79.1; 241/119; 209/138; 209/144; 209/154

[58] Field of Search ..... 209/144, 154, 139 A, 209/139 R, 138; 241/79.1, 119, 53, 61

[56] References Cited

U.S. PATENT DOCUMENTS

| | | | |
|---|---|---|---|
| 1,955,960 | 4/1934 | Hirsch | 241/53 |
| 1,963,469 | 6/1934 | Kuhr | 209/139.2 |
| 2,112,359 | 3/1938 | Crites | 241/121 X |
| 2,431,746 | 12/1947 | Franggrist | 241/61 X |
| 2,434,037 | 1/1948 | Ebersole et al. | 241/53 X |
| 3,511,445 | 5/1970 | Ashdown | 241/61 |

FOREIGN PATENT DOCUMENTS

| | | | |
|---|---|---|---|
| 3403940 | 6/1984 | Fed. Rep. of Germany | 241/119 |

*Primary Examiner*—S. Leon Bashore
*Assistant Examiner*—Thomas M. Lithgow
*Attorney, Agent, or Firm*—Arthur E. Fournier, Jr.

[57] ABSTRACT

Centrifugal air classifiers without rotating classifying blades are frequently used in present-day coal-fired power stations. For economical reasons, these obtain the coal to be burnt from different sources so that the pulverized-coal furnaces are operated with coals of varying quality. In this arrangement, it is disadvantageous that, when coals of particularly low quality are burnt, this classifier is not capable of supplying the fineness of pulverized coal required for proper combustion. The invention has the object of creating a centrifugal air classifier of the type initially mentioned which provides the possibility of proper combustion of several types of coal in a pulverized-coal furnace. This object is achieved when, in the feed duct for the mixture of material to be classified and carrier gas, a jacket is arranged which surrounds the coarse-material collecting hopper at a distance and which leaves open an annular gap, which can be more or less closed by adjustable deflecting plates, to the feed duct, and when, at the lower end of the annular space formed by the coarse-material collecting hopper and the jacket a spin-generating ring of regulating flaps is arranged.

1 Claim, 1 Drawing Figure

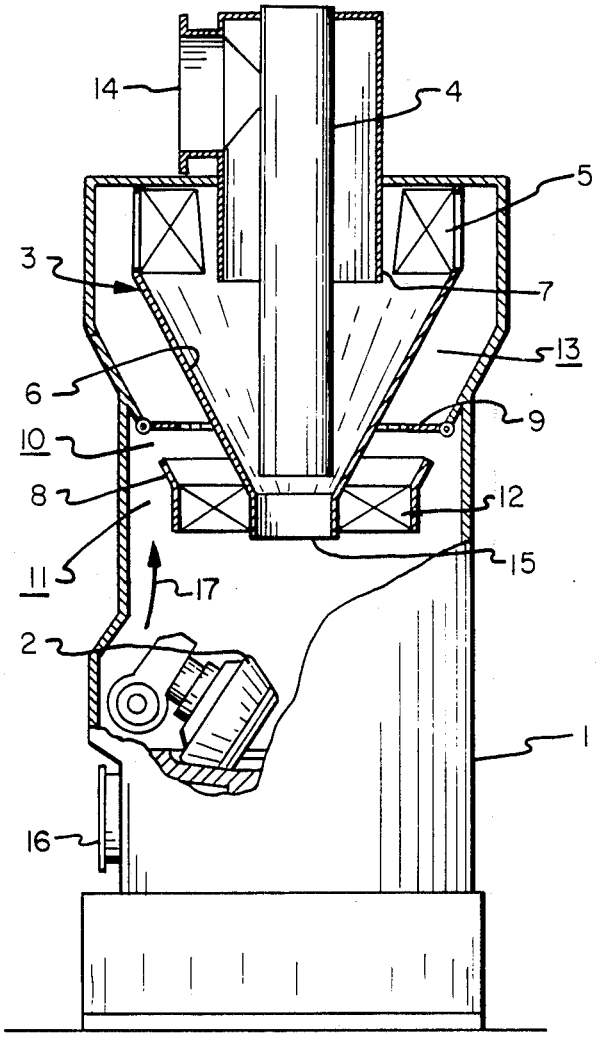
14
4
5
3
7
13
6
9
10
8
12
11
15
17
2
1
16

COAL-MILL CLASSIFIER

The invention relates to a centrifugal air classifier, of the type particularly suitable for use with coal mills, comprising a coaxial coarse-material collecting hopper which is arranged in the truncated-cone-shaped classifier housing and into which the material to be classified enters with the carrier gas through a spin-generating ring of regulating flaps and from which the mixture of fine material and carrier gas emerges from the classifier through a coaxial baffle tube and the coarse material is removed through the open lower end of the collecting hopper.

A device of the abovementioned type has been disclosed by German Pat. No. 940,083. Such classifiers are frequently used in present-day coal-fired power stations. For economical reasons, these obtain the coal to be burnt from different sources so that the pulverized-coal furnaces are operated with coals of varying quality. In this arrangement, it is disadvantageous that, when coals of particularly low quality are burnt, this classifier is not capable of supplying the fineness of pulverized coal required for proper combustion.

Normally, classifiers with rotating classifying blades are used for fine particles of pulverized coal, corresponding approximately to $<10\%$ oversize on an 0.09 aperture width test sieve. However, if coals needing such finenesses are burnt only from time to time, the use of such a classifier is uneconomical with regard to investment costs. To this is added another disadvantage: the power required for driving the classifier.

The invention has the object of creating a centrifugal air classifier of the type initially mentioned which provides the possibility of properly burning several types of coal in a pulverized-coal furnace.

This object is achieved when in the feed duct for the mixture of material to be classified and carrier gas, a jacket is arranged which surrounds the coarse-material collecting hopper at a distance and which leaves open an annular gap, which can be more or less closed by adjustable deflecting plates, to the feed duct and when at the lower end of the annular space formed by the coarse-material collecting hopper and the jacket a spin-generating ring of regulating flaps is arranged.

As a result of these measures according to the invention, the flaps of the two regulating rings and the deflecting plates in the annular space are set in such a manner that the fineness of pulverized coal can be achieved which is optimum for the proper combustion of the coal to be burnt in each case, without having to use an elaborate classifier with rotating classifying blades.

The invention is explained in greater detail with the aid of the description and the drawing:

The drawing shows a partial section of a roller-and-bowl mill for a pulverized-coal furnace, in the mill housing 1 of which the grinding part 2 is accommodated with the truncated-cone-shaped classifier 3, arranged above the latter, and the coaxial coal feeder tube 4. The upper section of the classifier 3 contains the spin-generating ring of regulating flaps. The lower section of the classifier 3 is used as collection hopper 6 for the separated coarse material. The classifier 3 has the coaxial baffle tube 7 which serves as flow-off connection 14 for the mixture of fine material and carrier gas to be carried out. The coarse-material collecting hopper 6 has the surrounding jacket 8 which is arranged at a distance and which leaves open an annular gap 10, which can be more or less closed by adjustable deflecting plates 9, to the feed duct 11. The annular gap 10 comprises the area defined by the deflecting plates 9, the outer surface of the collecting hopper 6, the top of the jacket 8 and the inner surface of the sidewall of the mill housing 1. The spin-generating ring of regulating flaps 12 is arranged at the lower end of the annular space 13 formed by the coarse-material collecting hopper 6 and the jacket 8.

The pulverized coal to be classified is carried by means of carrier gas, which enters the mill housing through a suitable air inlet seen at 16 in the drawing, and which while flowing in an upwardly direction as depicted by the arrow 17 in the drawing has entrained therein the coal particles that have been pulverized by virtue of the action of grinding part 2. The mixture of carrier gas and coal particles flows through the annular passage 11 whereupon the mixture of carrier gas and coal particles encounters the adjustable deflecting plates 9, and is caused to flow downwardly so as to pass through the spin-generating ring of regulating flaps 12. The mixture of carrier gas and coal particles is set in spinning motion by the spin-generating ring of regulating flaps 12 whereupon a first classification of the coal particles is effected. That is, the coarser of the coal particles are thrown outwardly, and in the course thereof strike the deflecting plates 9 that project into the annular space 13. As a result, under the influence of gravity the coarse coal particles fall downwards into the grinding part 2 of the mill 1 and are mixed in with the fresh fed-in material to be ground. At the same time, the mixture of carrier gas and the remainder of coal particles flows upwardly in the annular space 13 and is subjected to a second classification. More specifically, the mixture of carrier gas and the remainder of coal particles enters the spin-generating ring of regulating flaps 5 whereupon the mixture of carrier gas and the remainder of coal particles is set in spinning motion, and is brought into the classifier 3. Upon being brought into the classifier 3, the heaviest of the coal particles in known fashion precipitates downwards, and under the influence of gravity are made to leave the collecting hopper 6 through the opening 15 and are mixed in with the fresh fed-in material to be ground being supplied through the coal feeder tube 4. On the other hand, the mixture of carrier gas and fine coal particles leaves the classifier 3 through the baffle tube 7 of the flow-off connection 14 and is then fed to the furnace, not shown.

I claim:

1. A mill embodying a classifier and operative both to grind material and to separate thereafter the ground material into a larger particle fraction and a product smaller particle fraction comprising:

a. a mill housing;

b. a material feeder tube having an upper and lower end supported in said mill housing, said material feeder tube being operative to feed material to be ground into the interior of said mill housing;

c. grinding means supported in said mill housing in spaced relation to said material feeder tube so as to be positioned to receive the material to be ground from said material feeder tube, said grinding means being operative to effectuate the grinding therewithin of the material fed thereto;

d. classifier means comprising a downwardly converging cone shaped element supported within said housing in concentric alignment with said material feeder tube and having an opening at its lower converging end, said cone element defining an annular area between the mill housing and itself;

e. said classifier means further comprising jacket means supported in said mill housing in concentric alignment with said lower end of said cone element such that an annular passage is established between said lower end of said cone element and said jacket means;

f. said classifier means further comprising first spin-generating means supported in the annular passage established between said lower end of said cone element and said jacket means, said first spin-generating means including a plurality of regulating flaps, said plurality of regulating flaps of said first spin-generating means being operative to effect a separation of first larger particle fraction from a first smaller particle fraction of ground material passing through said first spin-generating means;

g. said classifier means further comprising adjustable deflecting plates mounted between said mill housing and said cone element for movement between a full open position and a full closed position relative to said annular area, said adjustable deflecting plates being operative to effect a return to said grinding means for further grinding of the larger particle fraction of ground material separated as a result of the action of said first spin-generating means;

h. said classifier means further comprising second spin-generating means supported by said mill housing in juxtaposed relation to the upper end of the cone element and in coaxial alignment with said material feeder tube, said second spin-generating means including a plurality of regulating flaps, said plurality of regulation flaps of said second spin-generating means being operative to effect a separation of a second larger particle fraction from the smaller product particle fraction of ground material passing through said second spin-generating means such that the larger of the particles of ground material separated as a result of the action of said second spin-generating means are made to return to said grinding means for further grinding; and i. said classifier means further comprising baffle tube means supported in said mill housing in concentric alignment with said upper end of said material feeder tube, said baffle tube means being cooperatively associated with said second spin-generating means so as to receive therefrom the product smaller particle fraction of ground material separated as the result of the action of said second spin-generating means for discharge from the mill as finished product.

* * * * *